US007312576B2

(12) United States Patent
Yoo

(10) Patent No.: US 7,312,576 B2
(45) Date of Patent: Dec. 25, 2007

(54) HIGH EFFICIENCY PLASMA DISPLAY PANEL (PDP) PROVIDED WITH ELECTRODES WITHIN LAMINATED DIELECTRIC BARRIER RIBS

(75) Inventor: Hun-Suk Yoo, Cheonan-si (KR)

(73) Assignee: Samsung SDI Co., Ltd., Suwon-si, Gyeonggi-do (KR)

( * ) Notice: Subject to any disclaimer, the term of this patent is extended or adjusted under 35 U.S.C. 154(b) by 214 days.

(21) Appl. No.: 11/103,457

(22) Filed: Apr. 12, 2005

(65) Prior Publication Data

US 2005/0231116 A1 Oct. 20, 2005

(30) Foreign Application Priority Data

Apr. 20, 2004 (KR) ..... 10-2004-0027144

(51) Int. Cl.
*H01J 17/49* (2006.01)

(52) U.S. Cl. ..... 313/584; 313/582; 313/586; 313/587; 313/292

(58) Field of Classification Search ..... 313/581–587, 313/292, 502–503, 505
See application file for complete search history.

(56) References Cited

U.S. PATENT DOCUMENTS

| | | | | |
|---|---|---|---|---|
| 5,541,618 | A | 7/1996 | Shinoda | |
| 5,661,500 | A | 8/1997 | Shinoda et al. | |
| 5,663,741 | A | 9/1997 | Kanazawa | |
| 5,674,553 | A | 10/1997 | Sinoda et al. | |
| 5,724,054 | A | 3/1998 | Shinoda | |
| 5,786,794 | A | 7/1998 | Kishi et al. | |
| 5,952,782 | A | 9/1999 | Nanto | |
| RE37,444 | E | 11/2001 | Kanazawa | |
| 6,630,916 | B1 | 10/2003 | Shinoda | |
| 6,707,436 | B2 | 3/2004 | Setoguchi et al. | |
| 6,897,610 | B1 * | 5/2005 | Aoki et al. | 313/586 |
| 2005/0225245 | A1 * | 10/2005 | Seo et al. | 313/582 |
| 2005/0231112 | A1 * | 10/2005 | Woo et al. | 313/582 |

FOREIGN PATENT DOCUMENTS

| | | |
|---|---|---|
| JP | 02-148645 | 6/1990 |

(Continued)

*Primary Examiner*—Mariceli Santiago
(74) *Attorney, Agent, or Firm*—Robert E. Bushnell, Esq.

(57) ABSTRACT

A PDP having a new discharge cell structure that improves light emission efficiency and light transmission by reducing reactive power that does not contribute to a discharge by reducing a displacement current between discharge electrodes includes: a transparent front substrate; a rear substrate arranged parallel to the front substrate; a plurality of front barrier ribs arranged between the front substrate and the rear substrate to define discharge cells together with the front substrate and the rear substrate, wherein each of the barrier ribs includes a front unit of a dielectric material, a rear unit of a dielectric material, and a central unit of a dielectric material having a lower dielectric constant than that of the front unit and the rear unit, the central unit being interposed between the front unit and the rear unit; a front discharge electrode and a rear discharge electrode disposed in the front barrier ribs surrounding the discharge cells, and separated from each other leaving the central unit therebetween; a plurality of rear barrier ribs arranged between the front barrier ribs and the rear substrate; fluorescent layers arranged in spaces defined by the rear barrier ribs; and a discharge gas filling the discharge cells.

8 Claims, 10 Drawing Sheets

FOREIGN PATENT DOCUMENTS

| | | | |
|---|---|---|---|
| JP | 2845183 | | 10/1998 |
| JP | 2917279 | | 4/1999 |
| JP | 2001-043804 | | 2/2001 |
| JP | 2001084913 A | * | 3/2001 |
| JP | 2001-325888 | | 11/2001 |

* cited by examiner

HIGH EFFICIENCY PLASMA DISPLAY PANEL (PDP) PROVIDED WITH ELECTRODES WITHIN LAMINATED DIELECTRIC BARRIER RIBS

CLAIM OF PRIORITY

This application makes reference to, incorporates the same herein, and claims all benefits accruing under 35 U.S.C. §119 from an application entitled HIGH EFFECTIVE PLASMA DISPLAY PANEL filed with the Korean Intellectual Property Office on 20 Apr. 2004, and there duly assigned Ser. No. 2004-27144.

BACKGROUND OF THE INVENTION

1. Technical Field

The present invention relates to a high efficiency Plasma Display Panel (PDP).

2. Related Art

A front panel of an alternate type three electrode surface discharge PDP comprises a front substrate, sustaining electrode pairs including Y electrodes and X electrodes formed on the rear surface of the front substrate, a front dielectric layer covering the sustaining electrode pairs, and a protection film covering the front dielectric layer. Each of the Y electrodes and X electrodes includes transparent electrodes and bus electrodes. The bus electrodes are connected to connecting cables on the left and right sides of the PDP.

A rear panel of an alternate type three electrode surface discharge PDP comprises a rear substrate, address electrodes crossing the sustaining electrode pairs on the front surface of the rear substrate, a rear dielectric layer covering the address electrodes, barrier ribs formed on the rear dielectric layer to define discharge cells, and fluorescent layers in the discharge cells. The address electrodes are connected to connecting cables on the upper and lower surfaces of the PDP.

The above-noted PDP has the problem of reduced transmission of visible light from the fluorescent layers in the discharge cells, since the sustaining electrode pairs causing a discharge, the front dielectric layer, and the protection film are formed on the rear surface of the front substrate, thereby reducing the brightness of the PDP.

Also, all of the sustaining electrode pairs except the bus electrodes are formed of ITO electrodes, which have a high resistance, since the sustaining electrode pairs causing a discharge are formed on the rear surface of the front substrate. This increases the operating voltage. Also, when the PDP is large, the high resistance of the ITO electrodes causes a voltage drop in the sustaining electrode pairs. This results in non-uniform images of the PDP.

Also, in the PDP, the discharge occurs at the rear of the protection film in the discharge cells, since the sustaining electrode pairs causing a discharge are formed on the rear surface of the front substrate through which the visible light passes. The occurrence of discharge on one surface among inner surfaces of the discharge cell reduces light emitting efficiency. Also, when the PDP is operated for a long time, charged particles accelerated by the electric field can cause an ion sputtering problem on the fluorescent layers by colliding with the fluorescent layers 125, thereby causing a permanent latent image.

In the PDP, a pulse voltage is applied to the address electrodes and the X electrodes. This results in a potential difference between the address electrodes and the X electrodes to generate a discharge. The discharge generates a wall charge on the rear surface of the protection film of a particular discharge cell. When an electric potential difference lower than the electric potential difference between the address electrodes and the X electrodes is generated alternately in the sustaining electrode pair, an electric potential difference greater than a predetermined firing voltage is generated on the rear surface of the protection film with the aid of the wall charge, causing a sustaining discharge. The wall charge is accumulated on the rear surface of the protection film by the pulse voltage applied to the sustaining electrode pair. From this result, a displacement current $I_{ad}$ flows between the X electrodes and the protection film and between the Y electrodes and the protection film. On the other hand, a pulse voltage is alternately generated between the sustaining electrode pair in the front dielectric layer, and a displacement current $I_{am}$ flows since the pulse voltage changes according to time. The displacement current $I_{am}$ does not contribute to forming the wall charge but is consumed as reactive power. The consumption of reactive power includes reactive power formed by the displacement current caused by the potential difference which changes according to time and flows in the dielectric, and power consumption caused by heat generated by a non-ideal dielectric. The consumption of the reactive power eventually increases the operating voltage of the PDP and reduces efficiency.

SUMMARY OF THE INVENTION

The present invention provides a PDP with increased brightness by improving transmission of visible light by employing a new discharge cell structure, and can increase emission efficiency of light by reducing the consumption of reactive power that does not contribute to the discharge between discharge electrodes.

According to an aspect of the present invention, a PDP is provided comprising: a transparent front substrate; a rear substrate arranged parallel to the front substrate; a plurality of front barrier ribs arranged between the front substrate and the rear substrate to define discharge cells together with the front substrate and the rear substrate, wherein each of the barrier ribs includes a front unit of a dielectric material, a rear unit of a dielectric material, and a central unit of a dielectric material having a lower dielectric constant than that of the front unit and the rear unit, the central unit being interposed between the front unit and the rear unit; a front discharge electrode and a rear discharge electrode disposed in the front barrier ribs surrounding the discharge cells, and separated from each other leaving the central unit therebetween; a plurality of rear barrier ribs arranged between the front barrier ribs and the rear substrate; fluorescent layers arranged in spaces defined by the rear barrier ribs; and a discharge gas filling the discharge cells.

The central unit of the front barrier ribs is preferably separated from the front discharge electrodes and the rear discharge electrodes.

The central unit of the front barrier ribs preferably comprises $SiO_2$.

The front discharge electrodes preferably extend in one direction and the rear discharge electrodes extend to cross the front discharge electrodes in the discharge cells.

The front discharge electrodes and the rear discharge electrodes preferably extend in one direction parallel to each other, and address electrodes preferably extend to cross the front discharge electrodes and the rear discharge electrodes in the discharge cells.

The address electrodes are preferably arranged between the rear substrate and the fluorescent layers, and a dielectric layer is preferably interposed between the address electrodes and the fluorescent layers.

The front discharge electrodes and the rear discharge electrodes each preferably comprises a ladder shape, and wherein at least the side surface of the front barrier ribs is preferably covered by a protective film.

The front barrier ribs and the rear barrier ribs preferably comprise a unitary structure.

BRIEF DESCRIPTION OF THE DRAWINGS

A more complete appreciation of the present invention, and many of the attendant advantages thereof, will be readily apparent as the present invention becomes better understood by reference to the following detailed description when considered in conjunction with the accompanying drawings in which like reference symbols indicate the same or similar components, wherein.

DETAILED DESCRIPTION OF THE INVENTION

Figure 1:
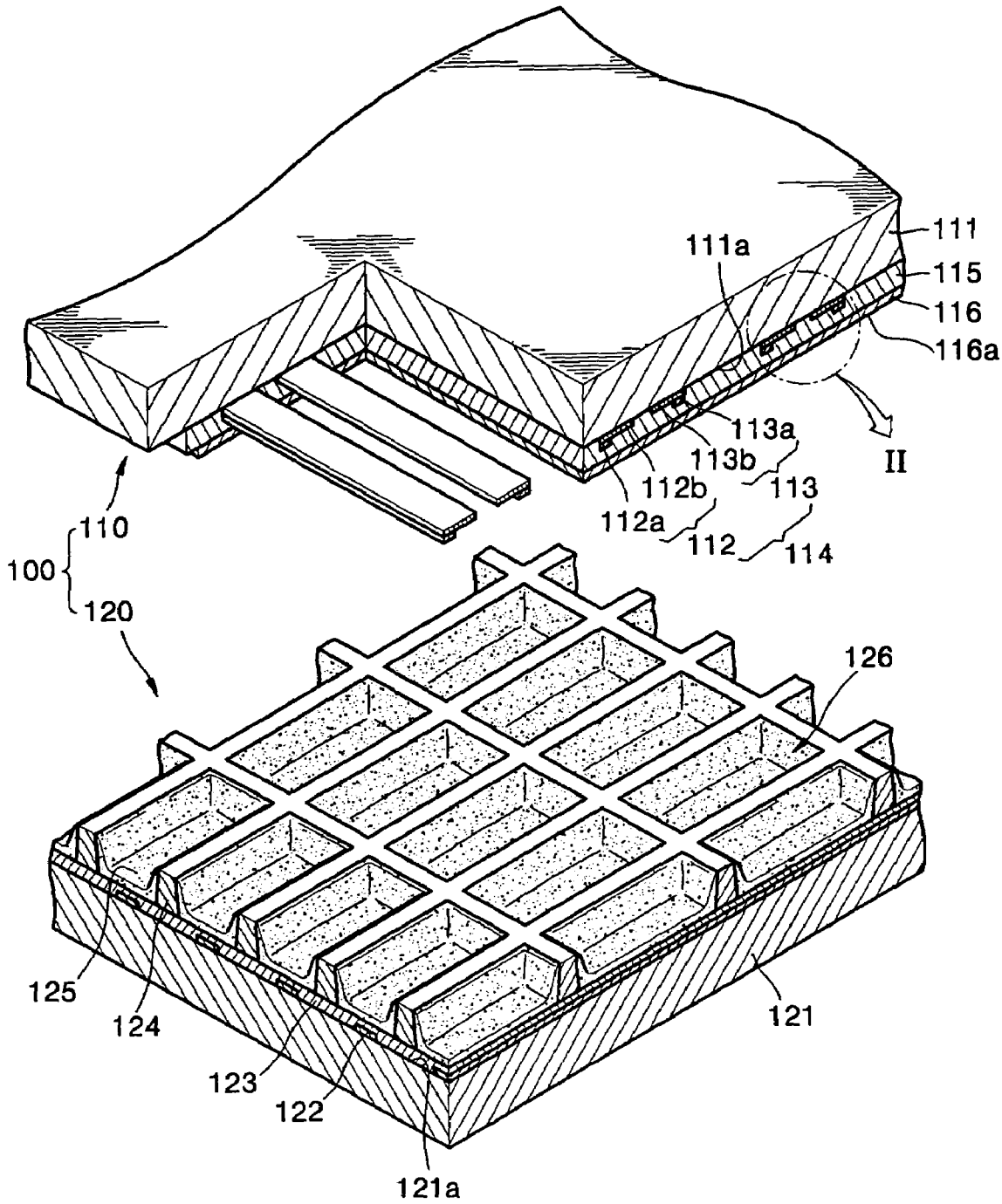
FIG. 1 is a cutaway exploded perspective view of a PDP.

FIG. 1 is a cutaway exploded perspective view of a PDP. Referring to FIG. 1, the structure of a front panel 110 and a rear panel 120 of an alternate type three electrode surface discharge PDP 100 is shown.

The front panel 110 comprises a front substrate 111, sustaining electrode pairs 114 including Y electrodes 112 and X electrodes 113 formed on the rear surface 111*a* of the front substrate 111, a front dielectric layer 115 covering the sustaining electrode pairs 114, and a protection film 116 covering the front dielectric layer 115. Each of the Y electrodes 112 and X electrodes 113 includes transparent electrodes 112*b* and 113*b* and bus electrodes 112*a* and 113*a*. The bus electrodes 112*a* and 113*a* are connected to connecting cables (not shown) on the left and right sides of the PDP 100.

The rear panel 120 comprises a rear substrate 121, address electrodes 122 crossing the sustaining electrode pairs 114 on the front surface 121*a* of the rear substrate 121, a rear dielectric layer 123 covering the address electrodes 122, barrier ribs 124 formed on the rear dielectric layer 123 to define discharge cells 126, and fluorescent layers 125 in the discharge cells 126. The address electrodes 122 are connected to connecting cables (not shown) on the upper and lower surfaces of the PDP 100.

The above-noted PDP has the problem of reduced transmission of visible light from the fluorescent layers 125 in the discharge cells 126, since the sustaining electrode pairs 114 causing a discharge, the front dielectric layer 115, and the protection film 116 are formed on the rear surface 111*a* of the front substrate 111, thereby reducing the brightness of the PDP.

Also, all of the sustaining electrode pairs 114 except the bus electrodes 112*b* and 113*b* are formed of ITO electrodes, which have a high resistance, since the sustaining electrode pairs 114 causing a discharge are formed on the rear surface 111*a* of the front substrate 111. This increases the operating voltage. Also, when the PDP is large, the high resistance of the ITO electrodes causes a voltage drop in the sustaining electrode pairs 114. This results in non-uniform images of the PDP.

Also, in the PDP 100, the discharge occurs at the rear of the protection film 116 in the discharge cells 126, since the sustaining electrode pairs 114 causing a discharge are formed on the rear surface 111*a* of the front substrate 111 through which the visible light passes. The occurrence of discharge on one surface among inner surfaces of the discharge cell 126 reduces light emitting efficiency. Also, when the PDP 100 is operated for a long time, charged particles accelerated by the electric field can cause an ion sputtering problem on the fluorescent layers 125 by colliding with the fluorescent layers 125, thereby causing a permanent latent image.

Figure 2:
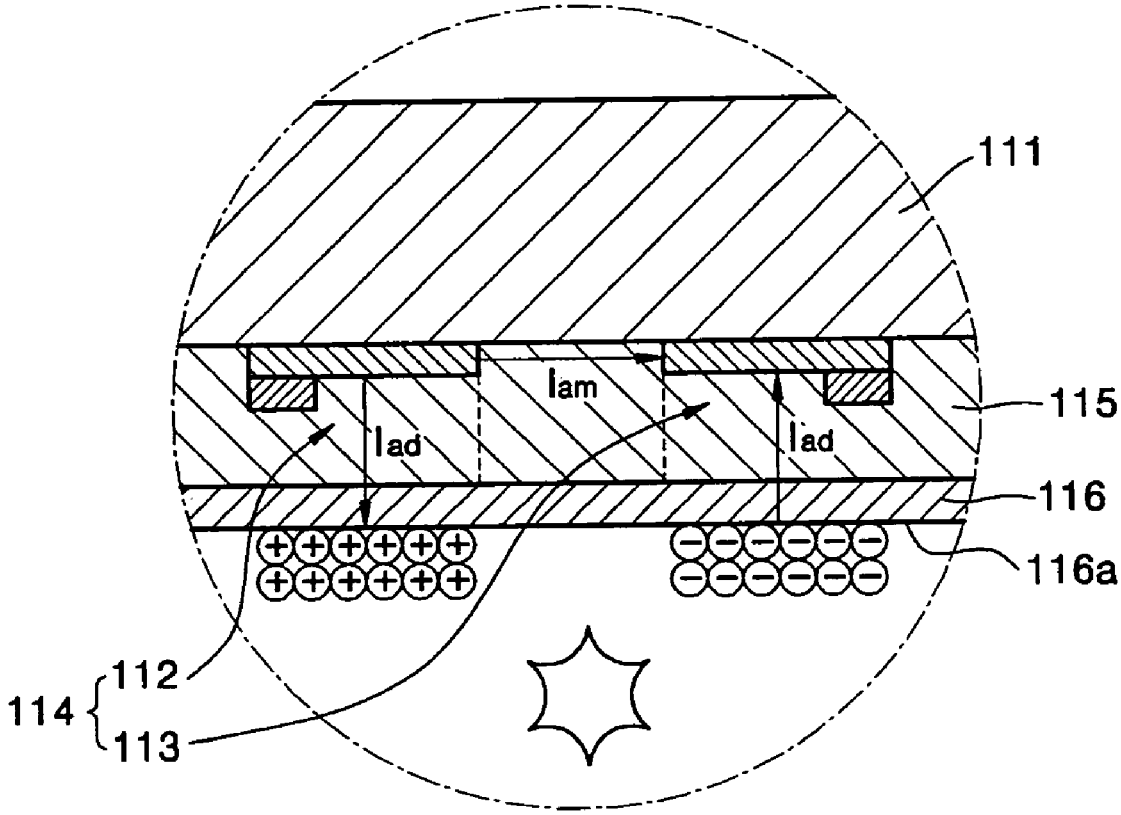
FIG. 2 is a cross-sectional view of a magnified portion II in FIG. 1 of a displacement current flowing in a dielectric layer covering a sustaining electrode pair and wall charge.

FIG. 2 is a magnified drawing of portion II in FIG. 1 of a cross-sectional view of a sustaining electrode pair of the PDP 100. Referring to FIG. 2, in the PDP 100, a pulse voltage is applied to the address electrodes 122 and the X electrodes 113. This results in a potential difference between the address electrodes 122 and the X electrodes 113 to generate a discharge. The discharge generates a wall charge on the rear surface 116*a* of the protection film 116 of a particular discharge cell 126. When an electric potential difference lower than the electric potential difference between the address electrodes 122 and the X electrodes 113 is generated alternately in the sustaining electrode pair 114, an electric potential difference greater than a predetermined firing voltage is generated on the rear surface 116*a* of the protection film 116 with the aid of the wall charge, causing a sustaining discharge. The wall charge is accumulated on the rear surface 116*a* of the protection film 116 by the pulse voltage applied to the sustaining electrode pair 114. From this result, a displacement current $I_{ad}$ flows between the X electrodes 113 and the protection film 116 and between the Y electrodes 112 and the protection film 116. On the other hand, a pulse voltage is alternately generated between the sustaining electrode pair 114 in the front dielectric layer 115, and a displacement current $I_{am}$ flows since the pulse voltage changes according to time. The displacement current $I_{am}$ does not contribute to forming the wall charge but is consumed as reactive power. The consumption of reactive power includes reactive power formed by the displacement current caused by the potential difference which changes according to time and flows in the dielectric, and power consumption caused by heat generated by a non-ideal dielectric. The consumption of the reactive power eventually increases the operating voltage of the PDP and reduces efficiency.

The present invention will now be described more fully with reference to the accompanying drawings in which embodiments of the invention are shown.

A first embodiment of the present invention will be described with reference to FIGS. 3 through 5.

Figure 3A:
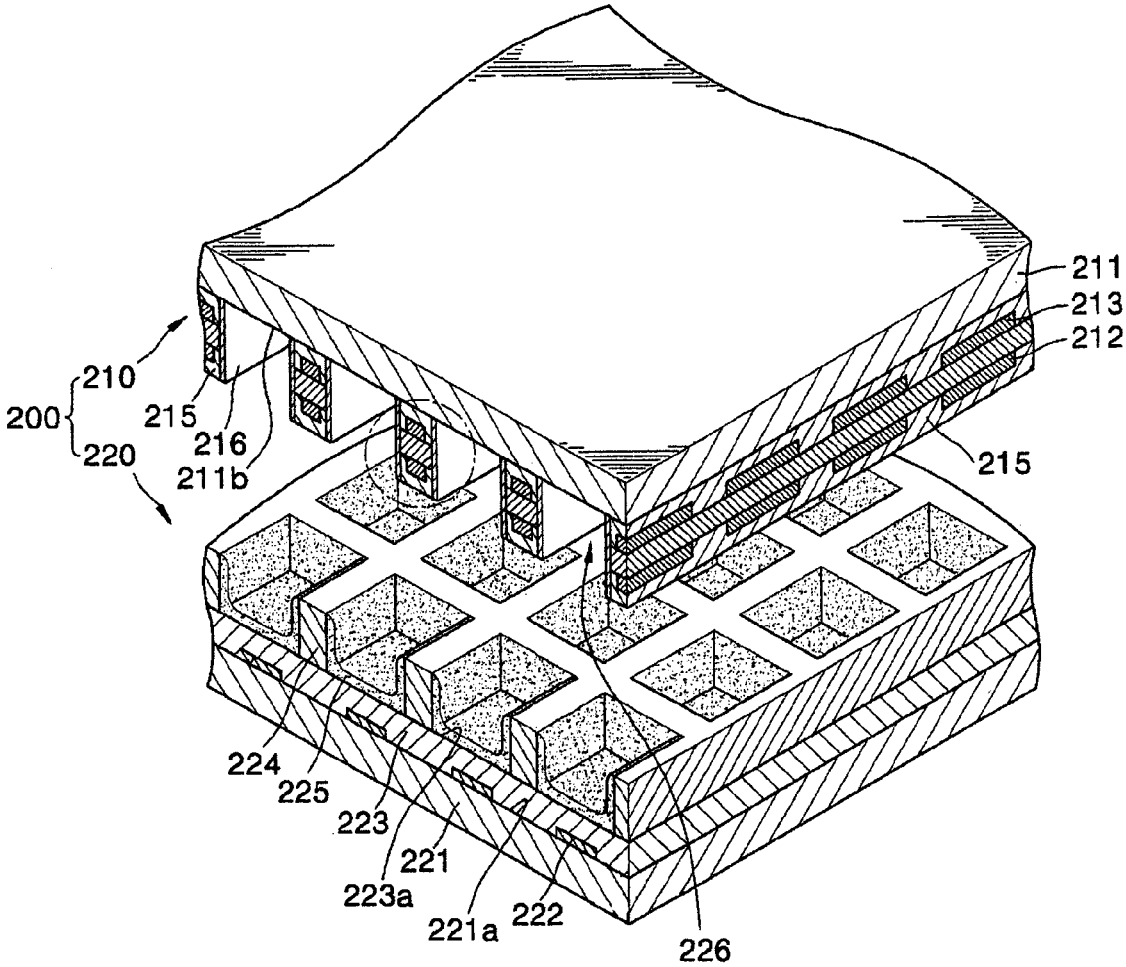
FIGS. 3A and 3B are an exploded perspective view of a PDP according to a first embodiment of the present invention.
Figure 3B:
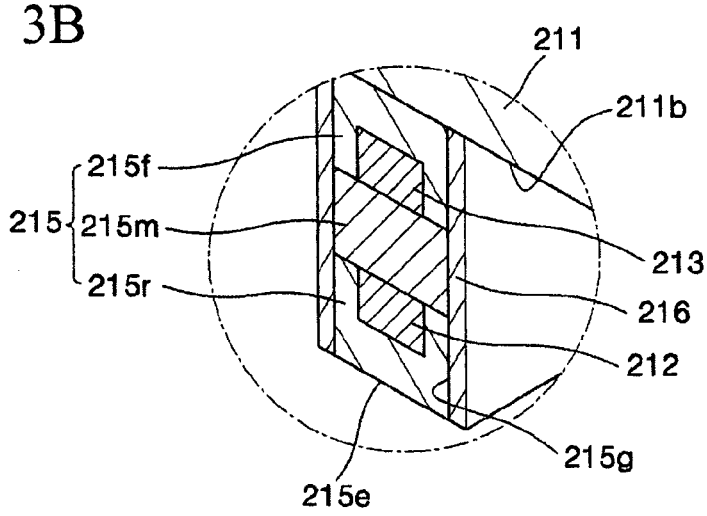

Referring to FIGS. 3A and 3B, a plasma display panel 200 comprises a front panel 210 and a rear panel 220. The front panel 210 includes a transparent front substrate 211 and the rear panel 220 includes a rear substrate 221 parallel to and facing the front substrate 211.

The front panel 210 comprises front barrier ribs 215 formed on the rear surface 211*b* of the front substrate 211. The front barrier ribs 215 define discharge cells 226 together with the front substrate 211 and the rear substrate 221. The front barrier ribs 215 include a front unit 215*f*, a rear unit 215*r*, and a central unit 215*m*, each formed of a dielectric. The central unit 215*m* is interposed between the front central unit 215*f* and the rear unit 215*r*. Also, the dielectric constant of the central unit 215*m* is lower than that of the front unit 215*f* and the rear unit 215*r*. The functions of the front unit 215*f*, the central unit 215*m*, and the rear unit 215*r* will be described later.

The front panel 210 also comprises front and rear discharge electrodes 213 and 212 located in the front barrier ribs 215 to surround the discharge cells 226, extending in parallel in one direction and separated by a predetermined distance, and a protection film 216 covering the side surface 215*g* of the front barrier ribs 215 which can be formed as necessary.

The rear panel 220 comprises the rear substrate 221, address electrodes 222 on the front surface 221*a* of the rear substrate 221 and extending to cross the front and rear discharge electrodes 213 and 212, a dielectric layer 223 covering the address electrodes 222, rear barrier ribs 224 formed on the dielectric layer 223, and fluorescent layers 225 in the space defined by the rear barrier ribs 224.

The front panel 210 and the rear panel 220 are coupled by a coupling member such as frit (not shown) and sealed, and the discharge cells 226 are filled with a discharge gas, such as Ne, He, and Ar or a mixture of these gases. The content of Xe in the discharge gas can be approximately 10%.

The front substrate 211 and the rear substrate 221 are generally formed of glass, and the front substrate 211 is preferably formed of a material having a high light transmission. The PDP 200 of the present embodiment does not include the sustaining electrode pairs 114, the front dielectric layer 115 covering the sustaining electrode pairs 114, and the protection film 116 covering the front dielectric layer 115, as exist on the rear surface 211*b* of the front substrate 211. Accordingly, the light transmission of the PDP 200 is considerably better than in the alternate type three electrode surface discharge PDP 100, disregarding any filters in front of the PDP, since the visible light emitted from the fluorescent layers 225 of the discharge cells 226 passes through only the transparent front substrate 211, which has high light transmission.

Also, in order to increase brightness, the PDP 200 can include a reflection layer (not shown) on the upper surface 221*a* of the rear substrate 221 or on the upper surface 223*a* of the dielectric layer 223, or a light reflecting material can be included in the dielectric layer 223, so that the visible light generated by the fluorescent layers 225 can be effectively reflected toward the front.

In a alternate type three electrode surface discharge PDP, the front discharge electrodes 213 and the rear discharge electrodes 212 are formed of ITO, which has a relatively high resistance, to increase light transmission. However, in the present embodiment, the material forming the front discharge electrodes 213 and the rear discharge electrodes 212 can be selected from materials having high electrical conductivity, such as Ag, Cu, Cr and a composite of these metals, without needing to consider the light transmission.

The front barrier ribs 215 are formed to define the discharge cells 226 together with the front substrate 211 and the rear substrate 221 on the rear surface 211*b* of the front substrate 211. In FIGS. 3A and 3B, the front barrier ribs 215 defining the discharge cells 226 are formed as a matrix, but the present invention is not limited thereto and the front barrier ribs 215 can be formed as a honeycomb or delta. Also, in FIGS. 3A and 3B, the cross-section of the discharge cells 226 is rectangular, but the present invention is not limited thereto and the cross-section of the discharge cells 226 can be triangular, or polygonal, such as a pentagonal, a circular, or an oval.

The front discharge electrodes 213 and the rear discharge electrodes 212 that surround the discharge cells 226 are located in the front barrier ribs 215. Also, referring to FIGS. 3A and 3B, in order to form the front discharge electrodes 213 and the rear discharge electrodes 212 in the front barrier ribs 215, the front unit 215*f* is formed on the rear surface 211*b* of the front substrate 211, and a hollow pattern is then formed on the front unit 215*f*. Afterward, the front discharge electrode 213 is formed in the hollow pattern. The central unit 215*m* is then formed on the front discharge electrodes 213, the rear discharge electrodes 212 are formed on the central unit 215*m*, and the rear unit 215*r* is formed on the rear discharge electrodes 212 to cover the rear discharge electrodes 212. The central unit 215*m* must be formed of a dielectric having a lower dielectric constant than that of the front unit 215*f* and the rear unit 215*r*. This can be SiO, which has a dielectric constant of 4-6, and the dielectric of the front unit 215*f* and the rear unit 215*r* can be PbO, which has a dielectric constant of 8-12. However, the materials for forming the dielectric are not limited thereto, and the materials for the front unit 215*f* and the rear unit 215*r* are not necessarily identical. When the materials for forming the dielectrics are not identical, the pulse voltage applied to the front discharge electrodes 213 and the rear discharge electrodes 212 can be controlled in consideration of the dielectric constants of the front unit 215*f* and the rear unit 215*r*. Each of the front unit 215*f*, the rear unit 215*r*, and the central unit 215*m* can include more than two layers (for example, to form a thick layer) as necessary.

As depicted in FIGS. 3A and 3B, at least a portion of the side surface 215*g* of the front barrier ribs 215 is preferably covered by the protection film 216, and the protection film 216 is preferably formed of MgO. The protection film 216 protects the front discharge electrodes 213, the rear discharge electrodes 212, and the front barrier ribs 215, and also aids the discharge through the easy emission of secondary electrons. Referring to FIGS. 3A and 3B, the protection film 216 can be formed by a method such as deposition. When depositing the protection film 216, a protection film can also be formed on the rear surface 215*e* of the front barrier ribs 215 and the rear surface 211*b* of the front substrate 211. However, the protection film 216 formed on the rear surface 215*e* of the front barrier ribs 215 and the rear surface 211*b* of the front substrate 211 does not adversely affect the operation of the PDP 200, but can increase the discharge efficiency by increasing the amount of secondary electrons.

On the other hand, the rear barrier ribs 224 can be formed on the dielectric layer 223. The rear barrier ribs 224 can be formed of glass containing elements such as Pb, B, Si, Al, and O, and when necessary, a filler such as $ZrO_2$, $TiO_2$, and $Al_2O_3$ and a pigment such as Cr, Cu, Co, Fe, $TiO_2$. Also, the rear barrier ribs 224 can be formed of a dielectric like the front barrier ribs 215.

The rear barrier ribs 224 secure a space for locating the fluorescent layer 225, define the discharge cells 226, and prevent cross talk between discharge cells 226. Also, together with the front barrier ribs 215, they resist the negative pressure generated by the vacuum (for example, 0.5 atm) of a discharge gas filled between the front panel 210 and the rear panel 220. The rear barrier ribs 224 can include a reflection material so that the visible light generated by the discharge cell can be reflected forward. Red, green and blue fluorescent layers 225 can be located in the space defined by the rear barrier ribs 224, and the fluorescent layers 225 are sectioned by the rear barrier ribs 224.

The fluorescent layers 225 are formed by drying and sintering a coating of fluorescent paste on the front surface 223*a* of the dielectric layer 223 and the side surface 224*a* of the rear barrier ribs 224, and is a mixture of solvent, a binder, and a red, green, or blue light emitting fluorescent material. The red light emitting fluorescent material can be Y(V,P)$O_4$:Eu, the green light emitting fluorescent material can be ZnSi04:Mn, $YBO_3$:Tb, and the blue light emitting fluorescent material can be BAM:Eu.

Figure 4:
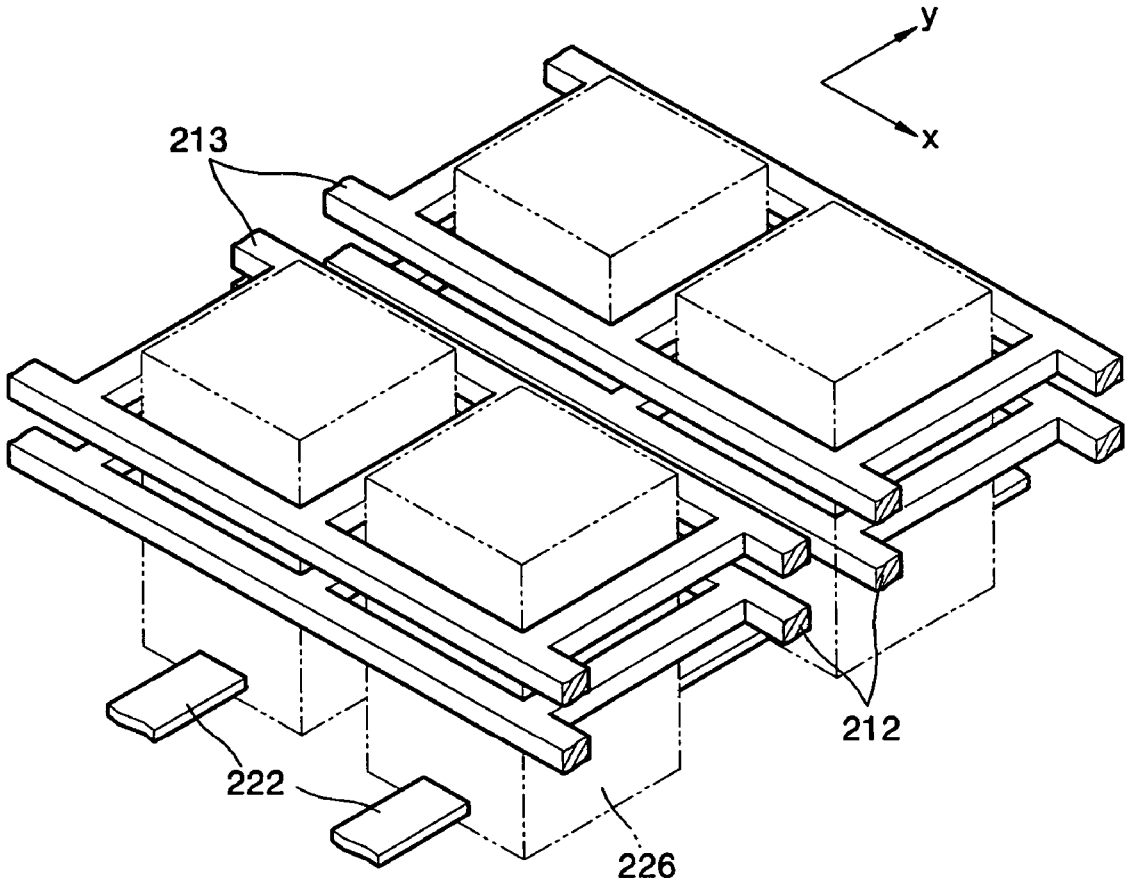
FIG. 4 is a perspective view of discharge cells, front discharge electrodes, rear discharge electrodes, and address electrodes according to a first embodiment of the present invention.
Figure 5:
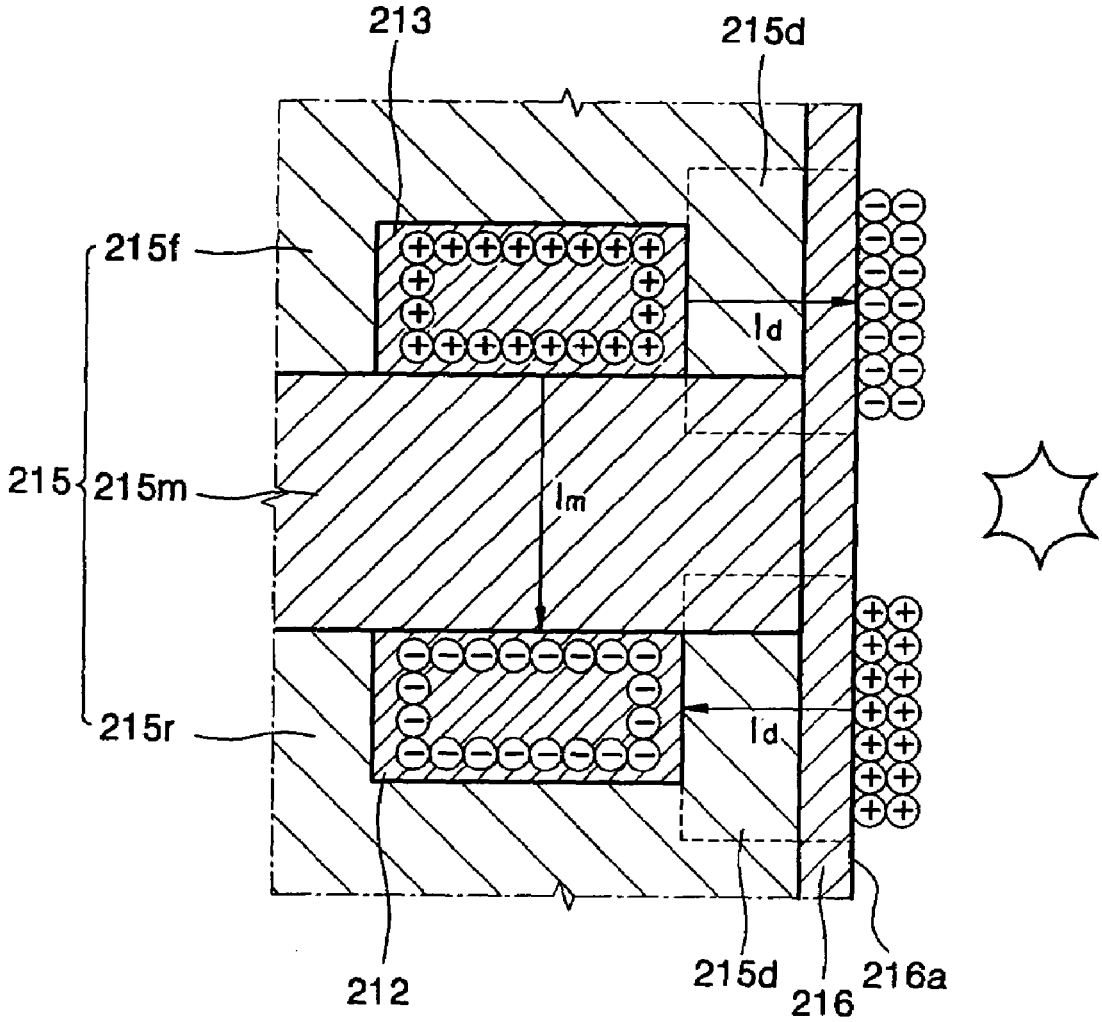
FIG. 5 is a cross-sectional view of charge distribution and displacement current when inserting a dielectric layer having a dielectric constant less than that of a front and rear unit of the front barrier rib into a central portion of the front barrier rib of the first embodiment of the present invention.

FIG. 4 is a view of the front discharge electrodes 213, the rear discharge electrodes 212, the address electrodes 222, and the discharge cells 226 according to the first embodiment. In FIG. 4, the front discharge electrodes 213 and the rear discharge electrodes 212 extend along the x axis parallel to each other, and the address electrodes 222 extend along the y axis to cross the front discharge electrodes 213 and the rear discharge electrodes 212.

On the other hand, it is preferable to have an address discharge, that selects a discharge cell, between the rear discharge electrodes 212 and the address electrodes 222 since the distance between the rear discharge electrodes 212 and the address electrodes 222 is shorter than that between the front discharge electrode 213 and the address electrodes 222. The rear discharge electrode 212 is preferably a common electrode and the front discharge electrode 213 is preferably a scan electrode, but the present invention is not limited thereto.

The central unit 215*m*, the front unit 215*f*, and the rear unit 215*r* of the front barrier ribs 215 will now be described with reference to FIG. 5. The front barrier rib 215 is formed of a dielectric and protects the front discharge electrodes 213 and the rear discharge electrodes 212 from being damaged by collision with charged particles during discharge. The front barrier ribs 215 also prevent a direct electrical connection between the front discharge electrodes 213 and the rear discharge electrodes 212. Also, the dielectric of the front barrier ribs 215 induces charged particles to generate wall charges during discharge, which allows discharge between the front discharge electrodes 213 and the rear discharge electrodes 212 to be able to occur at a voltage lower than a firing voltage.

$$Q=C*V=e*(A/d)*V \qquad \text{Equation 1}$$

The wall charge varies according to the voltage applied to the dielectric and the capacitance of the dielectric, as shown by Equation 1. In Equation 1, Q represents the amount of charge, C is capacitance, e is the dielectric constant of the dielectric, d is the thickness of the dielectric, A is the cross-sectional area of the dielectric, and V is the voltage applied to the dielectric. When applying Equation 1 to a discharge unit 215*d* of the front barrier ribs 215, Q represents the amount of wall charge accumulated by the discharge unit 215*d*, e is the dielectric constant of the dielectric, A is the area of the discharge unit 215*d*, and V is the voltage applied to the discharge unit 215*d*.

As shown by Equation 1, to increase the amount of wall charge, the capacitance of the discharge unit 215*d* must be increased or the pulse voltage applied to the front discharge electrodes 213 and the rear discharge electrodes 212 must be increased. However, there is a limit as to the increase of the pulse voltage used as an operating voltage. Therefore, to increase the amount of wall charge, the capacitance of the discharge unit 215*d* must be increased. To increase the capacitance, the thickness of the discharge unit 215*d* must be reduced, the cross-sectional area of the discharge unit 215*d* must be increased, or a strong dielectric material having a high dielectric constant must be used. However, the reduction of thickness and the increase in the cross-sectional area of the discharge unit 215*d* have limitations in terms of the structure, manufacturing process, and characteristics of discharge. Therefore, the use of strong dielectric material in the discharge unit 215*d* is considered most effective. Accordingly, the dielectric constant of the dielectrics of the front unit 215*f* and the rear unit 215*r*, which constitute the majority of the discharge unit 215*d*, must be increased. In the dielectric included in the discharge unit 215*d*, parts of the front unit 215*f* and the rear unit 215*r* contact the central unit 215*m* in series, but the parts of the central unit 215*m* included in the discharge unit 215*d* are relatively small compared to the overall area of the front unit 215*f* and the rear unit 215*r*. Therefore, the capacitance is not considerably reduced even though parts of the central unit 215*m* are included in the discharge unit 215*d*.

$$I=C*dv/dt \qquad \text{Equation 2}$$

As shown by Equation 2, when a voltage is applied to the dielectric, a displacement current I flows. The pulse voltage which is applied to the front discharge electrodes 213 and the rear discharge electrodes 212 changes according to time, and when the pulse voltage is V, a displacement current I flows in the central unit 215*m* and the discharge unit 215*d*. A displacement current Id that flows in the discharge unit 215*d* generates wall charges on the side surface 216*a* of the protection film 216. The generation of wall charge causes a potential difference, and then a discharge occurs on the side surface 216*a* of the protection film 216. Therefore, the displacement current Id that flows in the discharge unit 215*d* is regarded as directly aiding the discharge. However, the displacement current $I_m$ that flows in the central unit 215*m*, which is a dielectric between the front discharge electrodes 213 and the rear discharge electrodes 212, does not contribute to the formation of wall charges, and is consumed as reactive power. The consumed reactive power includes the reactive power formed by the displacement current flowing in the dielectric due to the potential difference that varies according to time, and power consumed by heat generated due to the non-ideal dielectric. The consumed reactive power increases the operating voltage needed for discharge, and eventually increases the operating voltage of the PDP and reduces its efficiency.

Therefore, a method is needed to reduce the displacement current Im. As can be seen from Equation 2, to reduce the displacement current Im, the capacitance C or the rate of change of the pulse voltage applied to the front discharge electrodes 213 and the rear discharge electrodes 212 must be reduced. However, since the rate of change of the operating pulse voltage is limited by the discharge characteristics, the capacitance C is preferably reduced.

As seen from Equation 2, the dielectric constant, the gap, or the cross-sectional area of the central unit 215*m* must be reduced to reduce the capacitance. However, the gap and the cross-sectional area are difficult to reduce, due to limitations of the structure and the manufacturing process, and therefore a dielectric having a low dielectric constant must be used for the central unit 215*m*.

Based on the above, the central unit 215*m* must be formed of a dielectric having a lower dielectric constant than that of the front unit 215*f* and the rear unit 215*r*. An example of a dielectric that can be used for the front unit 215*f* and the rear unit 215*r* is PbO, and an example of a dielectric that can be used for the central unit 215*m* is $SiO_2$.

The operation of the PDP 200 according to the first embodiment of the present invention is as follows.

When applying an address voltage between the address electrodes 222 and the rear discharge electrodes 212 from an external power source, a discharge cell 226 to be illuminated is selected, and then, wall charges are accumulated on the side surface of the barrier rib where the rear discharge electrodes 212 of the discharge cells 226 are located. Afterward, when a high voltage pulse is applied to the front discharge electrodes 213 and a relatively low voltage pulse is applied to the rear discharge electrodes 212, the wall charges migrate due to the potential difference between the front discharge electrodes 213 and the rear discharge electrodes 212. The collision of the migrated wall charges with atoms of the discharge gas in the discharge cells 226 generates a plasma and then a discharge in the cells 226. The discharge occurs more easily at points where the front discharge electrodes 213 are closest to the rear discharge electrodes 212, since a relatively strong electric field is formed at these points. Unlike an alternate type three electrode surface discharge PDP 200 in which the discharge occurs mainly on the rear of the front dielectric layer 215, that is, on the rear surface 216*a* of the protective film 216, in the case of the present embodiment, the possibility and the quantity of the discharge is significantly increased since the discharge occurs in the inner side surfaces of the discharge cell 226 where the front discharge electrode 213 and the rear discharge electrode 212 are located and the electric field generated by the front discharge electrodes and the rear electrode is concentrated.

Also, when the voltage between the front discharge electrodes 213 and the rear discharge electrodes 212 is maintained for a number of hours, the electric field formed on the inner side surfaces of the discharge cell 226 is concentrated at the center of the discharge cells 226. Accordingly, the discharge region is greater than that of the alternate type three electrode surface discharge PDP, and accordingly, the amount of ultraviolet radiation generated by the discharge is increased. Also, ion sputtering to the fluorescent layers 225 is prevented, since a discharge occurs from the surrounding area toward the center of the discharge cells 226, blocking the migration of ions colliding with the fluorescent layers 225.

When the voltage difference between the front discharge electrodes 213 and the rear discharge electrodes 212 after discharging is lower than the discharge voltage, no further discharge occurs, but space charges and wall charges are formed in the discharge cells 226. When generating a voltage between the front discharge electrodes 213 and the rear discharge electrodes 212 by applying an opposite voltage pulse to that initially applied to the front discharge electrodes 213 and the rear discharge electrodes 212, discharge occurs again by reaching the firing voltage with the aid of the wall charges. By applying the pulse voltage alternately to the front discharge electrodes 213 and the rear discharge electrodes 212, the discharge is continued.

Ultraviolet rays generated by the discharge excite fluorescent molecules of the fluorescent layers 225 by colliding with the fluorescent layers 225. When the excited fluorescent molecules fall from a higher energy level to a lower energy level, visible light is generated. Some of the visible light proceeds forward and the rest of the visible light proceeds forward after reflecting from the dielectric layer 223, the rear barrier ribs 224, or the rear substrate 221, and then, the visible light display an image on the PDP. A predetermined color image can be displayed when the red, green, or blue light fluorescent material is coated in each discharge cell of the unit pixels that form a color image.

Figure 6:
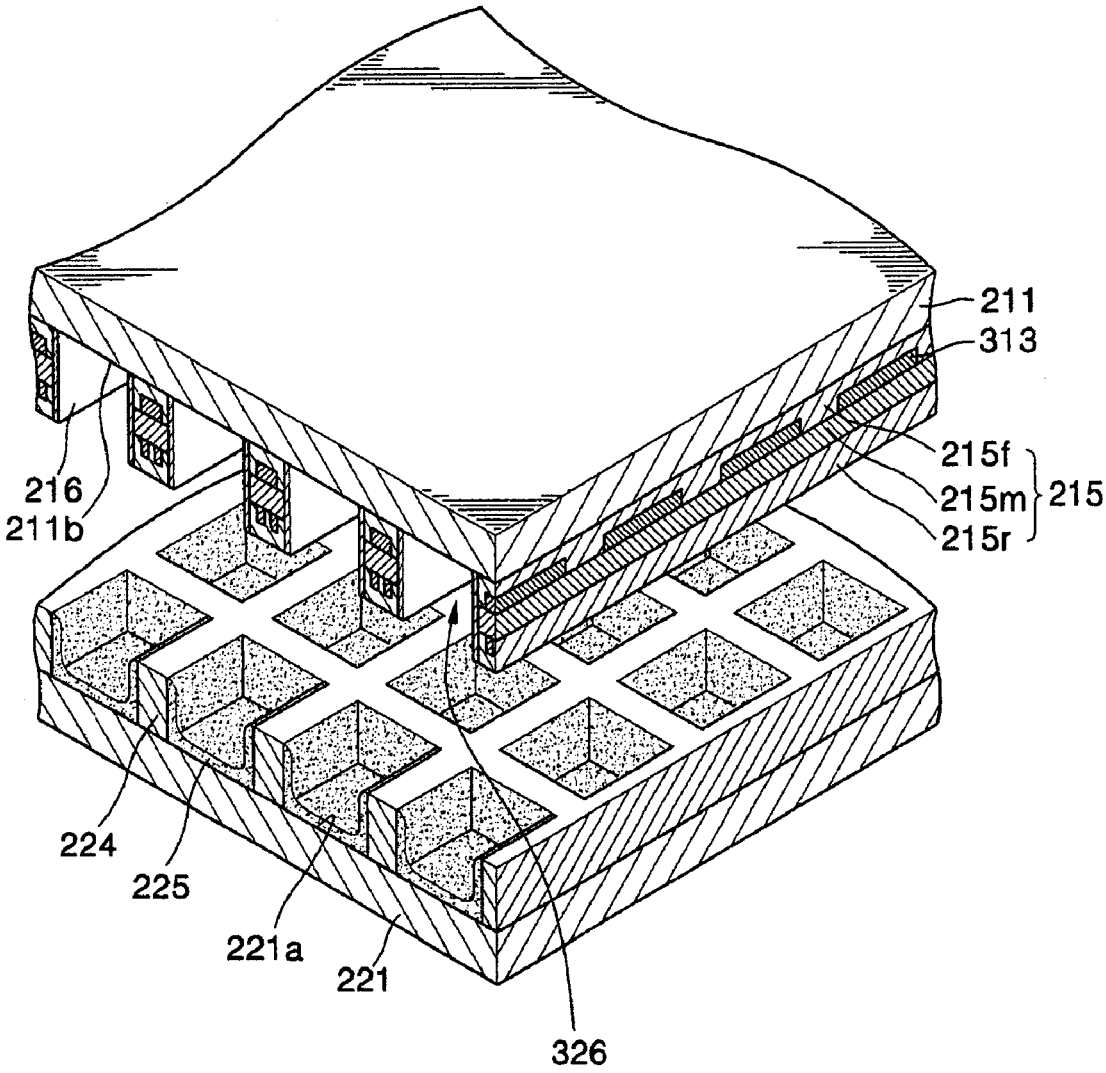
FIG. 6 is a perspective view of a first modified version of the PDP according to the first embodiment of the present invention.

A modified version of the PDP from the first embodiment of the present invention will now be described, focusing on the features which differ from the first embodiment, with reference to FIG. 6.

Figure 7:
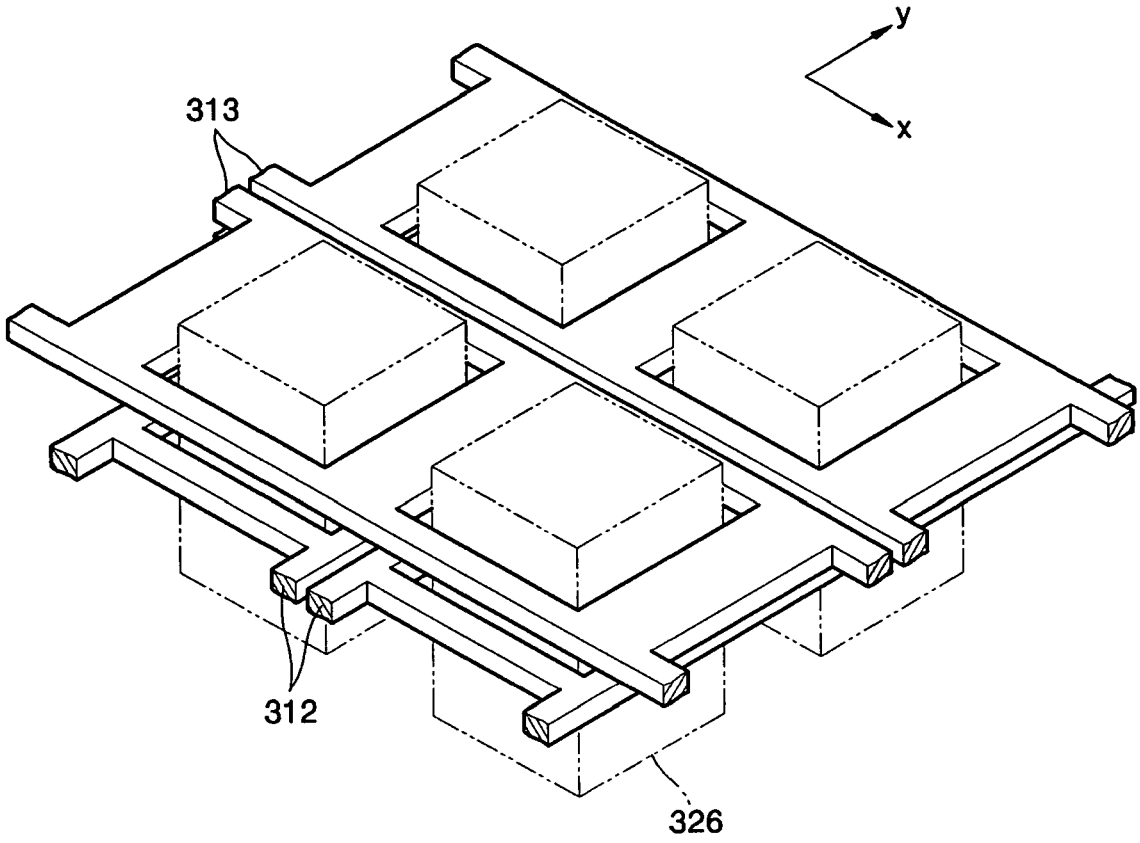
FIG. 7 is a perspective view of modified versions of discharge cells, front discharge electrodes, rear discharge electrodes, and address electrodes of the first embodiment of the present invention.

A PDP 300 according to a modified version of the first embodiment of the present invention does not include the address electrodes as in the first embodiment, but uses the front discharge electrodes 313 and rear discharge electrodes 312 to function as the address electrodes. Accordingly, no dielectric layer is needed to cover the address electrodes. As can be seen in FIG. 7, the front discharge electrodes 313, extending along the x axis, and the rear discharge electrodes 312, extending along the y axis and crossing the front discharge electrodes 313, surround discharge cells 326 without the address electrodes.

The operation of the PDP 300 according to the modified version of the first embodiment without the address electrodes will now be described, focusing on the differences from the first embodiment. In the modified version of the first embodiment, unlike the first embodiment, discharge cells are selected by causing an address discharge by applying a voltage to the front discharge electrode 313 and the rear discharge electrode 312 that cross each other in the discharge cell to be selected. As described above, wall charges are accumulated on the side surface of the discharge cell 326 by the address discharge. Afterward, as described in the first embodiment, sustaining discharges occur with the aid of the wall charge by applying an electrical potential difference alternately between the front discharge electrode 313 and the rear discharge electrode 312. An image is displayed on the PDP 300 as the result of the sustaining discharge in the discharge cells 326 of the PDP 300.

Figure 8A:
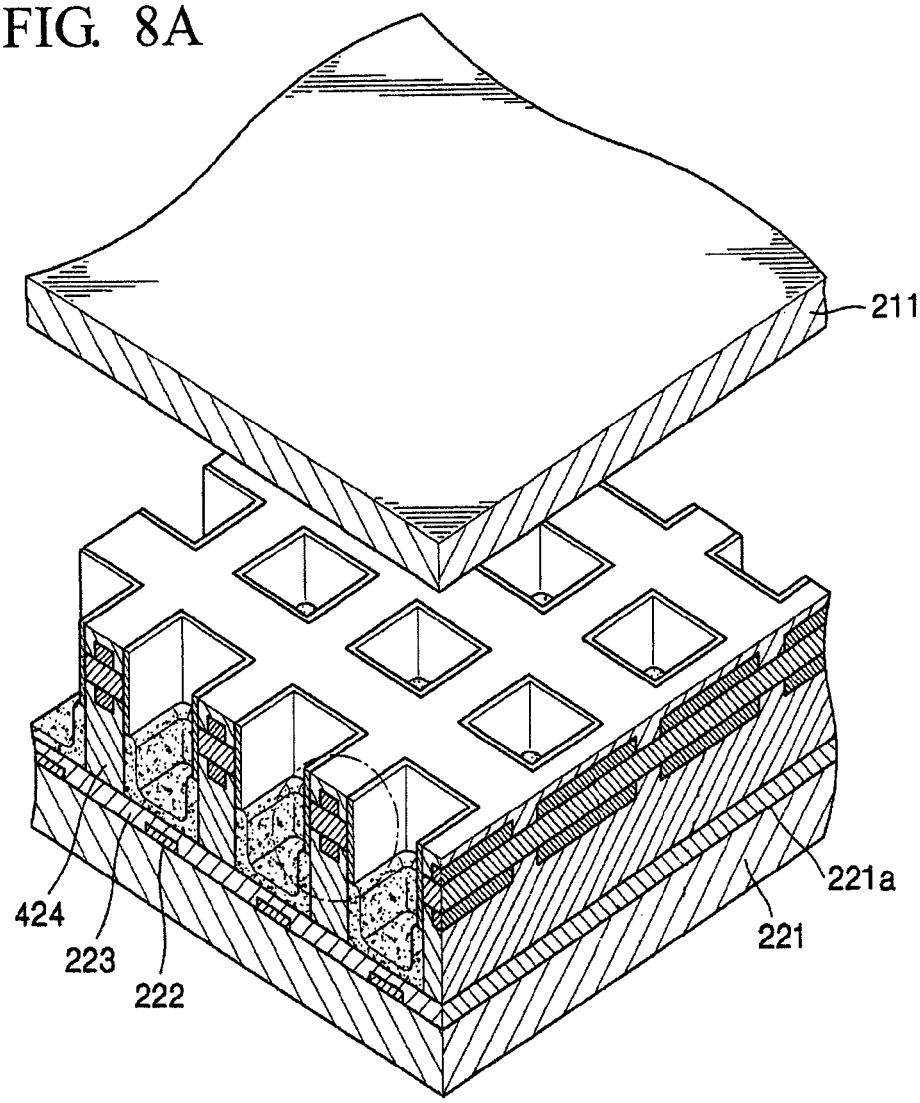
FIGS. 8A and 8B are an exploded perspective view of a second modified version of the PDP of the first embodiment of the present invention.
Figure 8B:
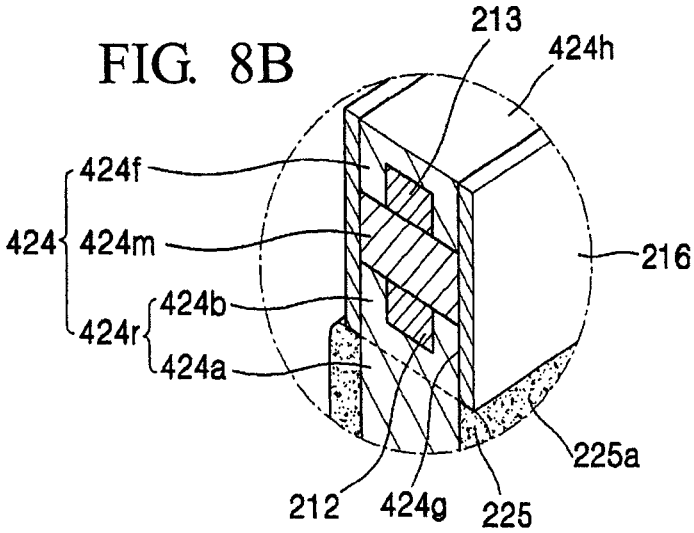

A second modified version of the first embodiment will now be described, focusing on the features which differ from the first embodiment, with reference to FIGS. 8A and 8B.

The PDP 400 of the second modified version of the first embodiment differs from that of the first embodiment in that the front barrier ribs 215 and the rear barrier ribs 224 formed in the PDP 200 are formed as a single combined barrier rib 424 in the modified version of the first embodiment. The combining the front barrier rib 215 and the rear barrier rib 224 into a single unit does not imply that the barrier rib 424 is formed by a single process, but rather that the front barrier rib 215 and the rear barrier rib 224 can not be separated without breaking since they are bonded together by an adhesive. To manufacture the single combined barrier rib 424, referring to FIG. 8B, a first rear unit 424*a* of the barrier rib 424 is formed on the front surface 221*a* of the rear substrate 221. After filling a paste that contains a fluorescent material into a space defined by the first rear unit 424*a*, the paste is dried and sintered.

Afterward, a rear unit 424*r* composed of the first rear unit 424*a* and a second rear unit 424*b* is formed by forming the second rear unit 424*b*. A hollow pattern is formed on the rear unit 424*r*, and the rear discharge electrode 212 is formed in the hollowed pattern. Next, a central unit 424*m* is formed on the rear discharge electrodes 212, and the front discharge electrode 213 is formed on the central unit 424*m*. Afterward, a front unit 424*f* is formed to cover the front discharge electrodes 213. The central unit 424*m* must be formed of a dielectric having a lower dielectric constant than the front unit 424*f* and the rear unit 424*r*. Each of the rear unit 424*r*, the front unit 424*f*, and the central unit 424*m* of the barrier rib 424 can include more than two layers (for example, to form a thick layer) as necessary.

After forming the barrier rib 424 by the above method, the protective film 216 is preferably formed on the side surface 424*g* of the front unit 424*f*, the central unit 424*m*, and the second rear unit 424*b* of the barrier rib 424 on which at least the front discharge electrode 213 and the rear discharge electrode 212 are formed. When depositing the protective film 216, it can also be formed on the upper surface 225*a* of the fluorescent layer 225 and the front surface 424*h* of the barrier rib 424. However, the protective film 216 formed on the upper surface 225*a* of the fluorescent layer 225 and the front surface 424*h* of the barrier rib 424 does not adversely affect the operation of the PDP 400. On the contrary, the protection film 216 can increase the emission of secondary electrons, thereby helping the discharge and prevent the degradation of the fluorescent layer 225.

Figure 9A:
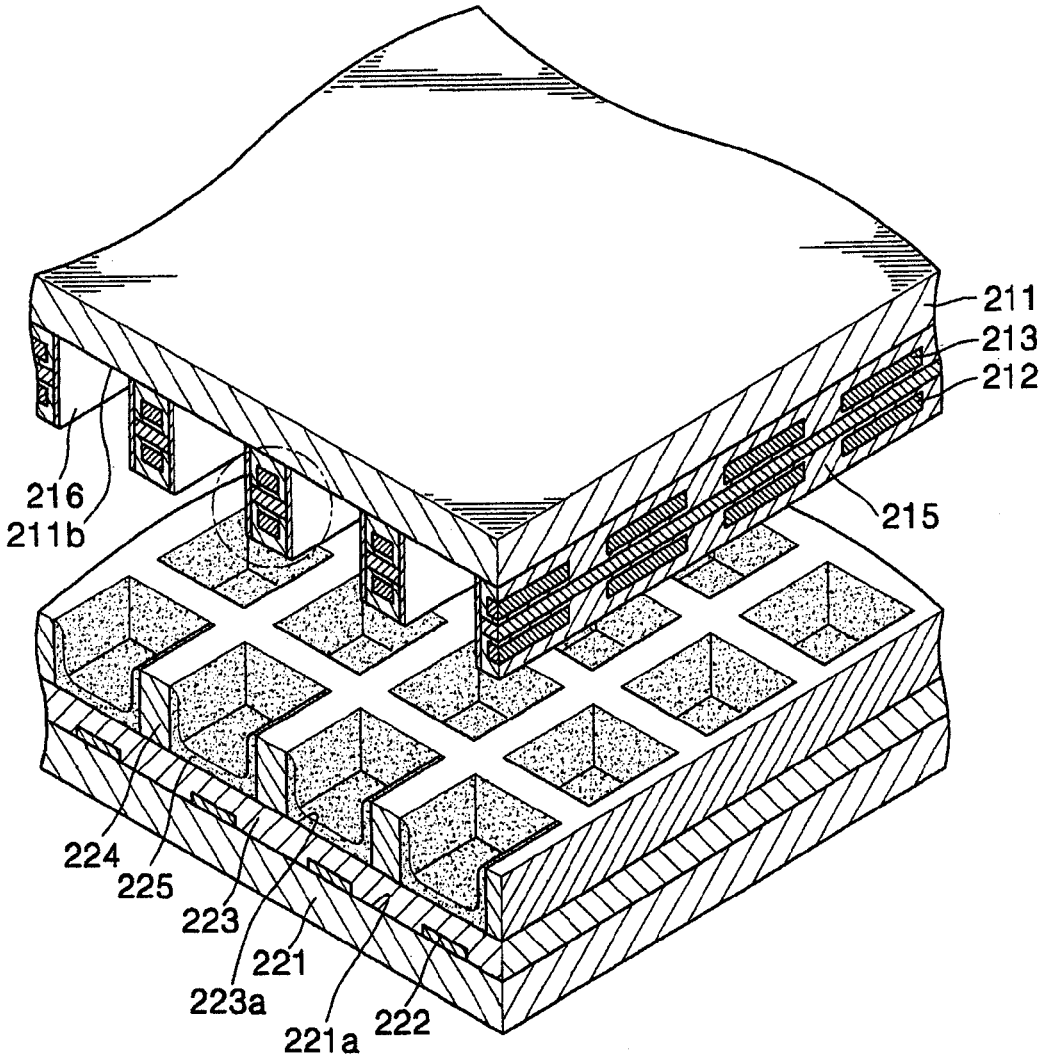
FIGS. 9A and 9B are an exploded perspective view of a PDP according to a second embodiment of the present invention.
Figure 9B:
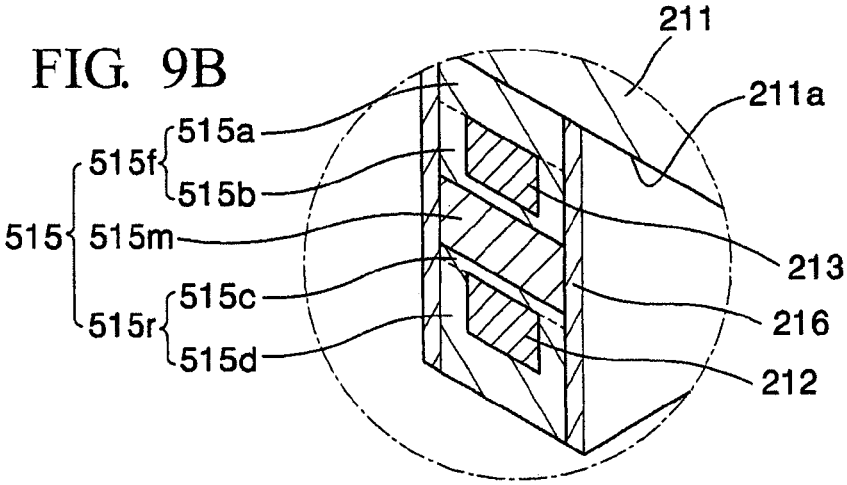

A second embodiment will now be described, focusing on the differences from the first embodiment, with reference to FIGS. 9A and 9B.

The PDP 500 of the second embodiment differs from that of the first embodiment in that a central unit 515*m* of a front barrier rib 515 included in the PDP 500 is formed at a distance from the front discharge electrodes 213 and the rear discharge electrodes 212.

The manufacturing process of the front barrier rib 515 of the present embodiment will now be described briefly with reference to FIG. 9B. A front unit 515*f* is composed of a first front unit 515*a* formed on the rear surface 211*a* of the front substrate 211, and a second front unit 515*b* formed after the formation of the front discharge electrode 213 to cover the front discharge electrode 213 on the first front unit 515*a*. The central unit 515*m* is formed on the front unit 515*f*, of a dielectric having a lower dielectric constant than that of the front unit 515*f* and the rear unit 515*r*. Afterward, a first rear unit 515*c* is formed on the central unit 515*m*, and the rear discharge electrode 212 is formed on the first rear unit 515*c*. The rear unit 515*r* is composed of the first rear unit 515*c* and a second rear unit 515*d* covering the rear discharge electrode 212.

Figure 10:
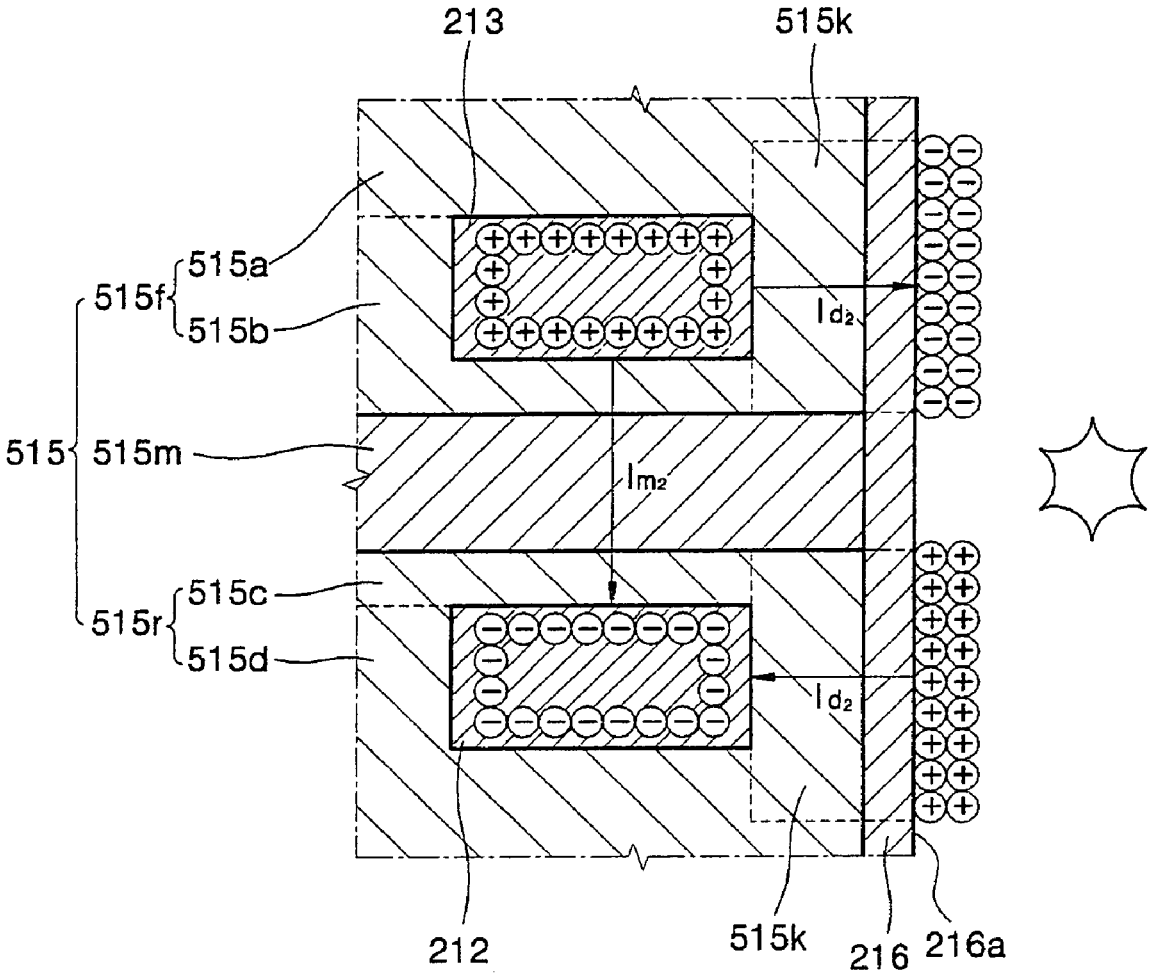
FIG. 10 a cross-sectional view of charge distribution and displacement current when inserting a dielectric layer having a dielectric constant less than that of a front and rear unit of the front barrier rib into a central portion of the front barrier rib of the second embodiment of the present invention.

The functions of the central unit 515*m*, the front unit 515*f*, and the rear unit 515*r* of the PDP 500 will now be described, focusing on the differences from the first embodiment, with reference to FIG. 10. The second front unit 515*b* and the first rear unit 515*c* are respectively formed in the front and rear of the central unit 515*m*. A discharge unit 515*k*, which is the dielectric which contributes to the discharge, is composed of the front unit 515*f* and the rear unit 515*r* by forming the second front unit 515*b* and the first rear unit 515*c*. The discharge unit 515*k* is a stronger dielectric than the central unit 515*m* since the dielectric constant of the front unit 515*f* and the rear unit 515*r* is greater than that of the central unit 515*m*. As shown by Equation 1, more wall charge accumulates on both sides of the front barrier rib 515 than that in the first embodiment, since the capacitance C is increased. As a result, the sustaining discharge occurs easily at a lower operating voltage, thereby reducing the overall operating voltage pf the PDP 500. On the other hand, a displacement current $I_{m2}$ flows between the front discharge electrodes 213 and the rear discharge electrodes 212 as described in the first embodiment. The displacement current $I_{m2}$ does not contribute to generating wall charges on the rear surface 216*a* of the protection film 216, and is wasted as reactive power. Therefore, the displacement current $I_{m2}$ must be reduced for the same reason as described in the first embodiment. To reduce the displacement current $I_{m2}$, as described in the first embodiment, the capacitance of the dielectric of the central unit 515*m* is preferably reduced. Since the second front unit 515*b* and the first rear unit 515*c* are interposed between the front discharge electrodes 213 and the rear discharge electrodes 212 as well as the central unit 515*m*, by inserting a dielectric having a lower dielectric constant than that of the front unit 515*f* and the rear unit 515*r* in the central unit 515*m*, the capacitance of the dielectric between the front discharge electrodes 213 and the rear discharge electrodes 212 can be reduced, and accordingly, the reactive power can be reduced by the reduction of the displacement current $I_{m2}$. The reduction of the reactive power for the same discharge brings about the reduction of the overall operating voltage. That is, the efficiency of the PDP is increased by reducing power consumption that does not contribute to the discharge.

The dielectric for the central unit 515*m* can be $SiO_2$, and for the front unit 515*f* and the rear unit 515*r* can be PbO.

In the present embodiment, the central unit can be located between the front discharge electrode and the rear discharge electrode, because the central unit is formed of a dielectric having a lower dielectric constant than that of the front unit and the rear unit in order to reduce reactive power as described above. Therefore, the central unit can be formed to surround the front barrier rib with the same width as the front discharge electrode and the rear discharge electrode, and located between the front discharge electrode and the rear discharge electrode. However, the present invention is not limited thereto and the shape and location of the central unit can vary.

The PDP according to the present invention employs a structure in which discharge electrodes are located in the barrier ribs and surround the discharge cells, unlike the structure of an PDP in which sustaining electrodes are formed in the front panel. Therefore, the PDP of the present invention needs no dielectric layer or protection film in front of the front panel, giving it significantly higher light transmission, since the visible light generated by the fluorescent layer in the discharge cell can pass directly through the front substrate.

In an alternate type three electrode surface discharge PDP, the majority of the sustaining electrodes that cause the discharge must be formed of ITO, which has a high resistance, to transmit the visible light generated by the fluorescent layers in the discharge cells, since the sustaining electrodes are located on the rear of the front substrate. This increases the operating voltage of the PDP and causes non-uniform images in a large PDP due to the voltage drop of the ITO electrodes. However, the PDP according to the present invention solves these problems, since the discharge electrodes are located in the barrier ribs and can therefore be formed of a material having high electric conductivity.

Also, an alternate type three electrode surface discharge PDP has a low light emitting efficiency, since the sustaining electrodes that cause the discharge are located on the rear of the front substrate, and the discharge occurs on the rear of the protective film and diffuses into the discharge cells. Also, a permanent latent image can form due to ion sputtering of charged particles of a discharge gas by an electric field after long use. However, the present invention solves the ion sputtering problem since the discharge occurs on the entire side surfaces that surround the discharge cells and is concentrated on the center.

The present invention can provide an efficient PDP, since the consumption of reactive power can be reduced by reducing the displacement current that flows between the front discharge electrodes and the rear discharge electrodes and does not contribute to discharge, unlike an alternate type three electrode surface discharge PDP, and the overall operating voltage can be reduced by inserting a ferroelectric material in a discharge unit of the front barrier rib that is involved in the discharge, thereby reducing the overall operating power consumption.

While the present invention has been particularly shown and described with reference to exemplary embodiments thereof, it will be understood by those of ordinary skill in the art that various modifications in form and details can be made therein without departing from the spirit and scope of the present invention as defined by the following claims.

What is claimed is:

1. A PDP comprising:

a transparent front substrate;

a rear substrate arranged parallel to the front substrate;

a plurality of front barrier ribs arranged between the front substrate and the rear substrate to define discharge cells together with the front substrate and the rear substrate, wherein each of the barrier ribs includes a front unit of a dielectric material, a rear unit of a dielectric material, and a central unit of a dielectric material having a lower dielectric constant than that of the front unit and the rear unit, the central unit being interposed between the front unit and the rear unit;

a front discharge electrode and a rear discharge electrode disposed in the front barrier ribs surrounding the discharge cells, and separated from each other leaving the central unit therebetween;

a plurality of rear barrier ribs arranged between the front barrier ribs and the rear substrate;

fluorescent layers arranged in spaces defined by the rear barrier ribs; and a discharge gas filling the discharge cells.

2. The PDP of claim 1, wherein the central unit of the front barrier ribs is separated from the front discharge electrodes and the rear discharge electrodes.

3. The PDP of claim 1, wherein the central unit of the front barrier ribs comprises $SiO_2$.

4. The PDP of claim 1, wherein the front discharge electrodes extend in one direction and the rear discharge electrodes extend to cross the front discharge electrodes in the discharge cells.

5. The PDP of claim 1, wherein the front discharge electrodes and the rear discharge electrodes extend in one direction parallel to each other, and further comprising address electrodes extending to cross the front discharge electrodes and the rear discharge electrodes in the discharge cells.

6. The PDP of claim 5, wherein the address electrodes are arranged between the rear substrate and the fluorescent layers, and further comprising a dielectric layer interposed between the address electrodes and the fluorescent layers.

7. The PDP of claim 1, wherein the front discharge electrodes and the rear discharge electrodes each comprises a ladder shape, and wherein at least the side surface of the front barrier ribs is covered by a protective film.

8. The PDP of claim 1, wherein the front barrier ribs and the rear barrier ribs comprise a unitary structure.

* * * * *